US012102227B2

(12) United States Patent
Ventura Vela

(10) Patent No.: US 12,102,227 B2
(45) Date of Patent: Oct. 1, 2024

(54) COFFIN SHAPED CABINET ASSEMBLY

(71) Applicant: Manuel Ventura Vela, Houston, TX (US)

(72) Inventor: Manuel Ventura Vela, Houston, TX (US)

( * ) Notice: Subject to any disclaimer, the term of this patent is extended or adjusted under 35 U.S.C. 154(b) by 114 days.

(21) Appl. No.: 17/984,334

(22) Filed: Nov. 10, 2022

(65) Prior Publication Data

US 2024/0156255 A1 May 16, 2024

(51) Int. Cl.
*A47B 67/02* (2006.01)

(52) U.S. Cl.
CPC ..... *A47B 67/02* (2013.01)

(58) Field of Classification Search
CPC ..... A47B 81/00; A47B 67/02
USPC ..... 312/204
See application file for complete search history.

(56) References Cited

U.S. PATENT DOCUMENTS

| | | | | |
|---|---|---|---|---|
| 3,930,702 | A | 1/1976 | Pichowicz | |
| D259,353 | S | 5/1981 | Slemmons | |
| 6,161,705 | A | 12/2000 | Riga | |
| 7,036,196 | B2 | 5/2006 | Salatin | |
| D610,800 | S | 3/2010 | Jusic | |
| 7,798,337 | B2 | 9/2010 | Gard | |
| D630,426 | S | 1/2011 | Wilfer | |
| 8,499,502 | B2 | 8/2013 | Browe | |
| 9,307,837 | B2 * | 4/2016 | Wood | A47B 67/02 |
| 2015/0173989 | A1 * | 6/2015 | Mitchell | B65D 9/12 220/4.28 |
| 2017/0099945 | A1 * | 4/2017 | Meads | A47G 1/00 |

FOREIGN PATENT DOCUMENTS

| | | |
|---|---|---|
| WO | WO9908577 | 2/1999 |

OTHER PUBLICATIONS

Printout from Internet archive from CoffinltUp.com (Year: 2021).*

* cited by examiner

*Primary Examiner* — Daniel J Rohrhoff

(57) ABSTRACT

A coffin shaped cabinet assembly includes a cabinet that has an outer wall which has a pair of protrusions on opposing sides of the cabinet such that the cabinet has the ornamental appearance of a coffin. A pair of first doors is each of the first doors is hingedly coupled to the cabinet. Each of the first doors is positioned adjacent to a respective one of the protrusions on the outer wall of the cabinet. A pair of second doors is each of the second doors is hingedly coupled to the cabinet. Each of the second doors is positioned adjacent to a respective one of the protrusions on the outer wall of the cabinet. A pair of handles is each coupled to a respective one of the second doors for opening the second doors.

12 Claims, 4 Drawing Sheets

COFFIN SHAPED CABINET ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to cabinet device and more particularly pertains to a new cabinet device which has the ornamental appearance of a coffin. The device includes a pair of first doors and a pair of second doors that are each aligned with a respective quadrant of the cabinet. A plurality of trim members is attached to respective ones of the first doors and the second doors. The plurality of trim members form a cross shape when the first doors and the second doors are closed to enhance the ornamental appearance of the cabinet.

(2) Description of Related Art Including Information Disclosed Under 37 CFR 1.97 and 1.98

The prior art relates to cabinet devices including a variety of cabinets that each has a rectilinear shape. The prior art discloses a variety of display case devices for a casket for supporting the casket in a horizontal orientation. The prior art discloses a variety of display cases for displaying portions of a casket to facilitate a customer to choose various features of a casket. The prior art discloses a toy casket device that has a trapezoidal shape. The prior art discloses an ornamental design of a carrying case that has the appearance of a casket. The prior art discloses a musical instrument case that has the ornamental appearance of a casket.

BRIEF SUMMARY OF THE INVENTION

An embodiment of the disclosure meets the needs presented above by generally comprising a cabinet that has an outer wall which has a pair of protrusions on opposing sides of the cabinet such that the cabinet has the ornamental appearance of a coffin. A pair of first doors is each of the first doors is hingedly coupled to the cabinet. Each of the first doors is positioned adjacent to a respective one of the protrusions on the outer wall of the cabinet. A pair of second doors is each of the second doors is hingedly coupled to the cabinet. Each of the second doors is positioned adjacent to a respective one of the protrusions on the outer wall of the cabinet. A pair of handles is each coupled to a respective one of the second doors for opening the second doors.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
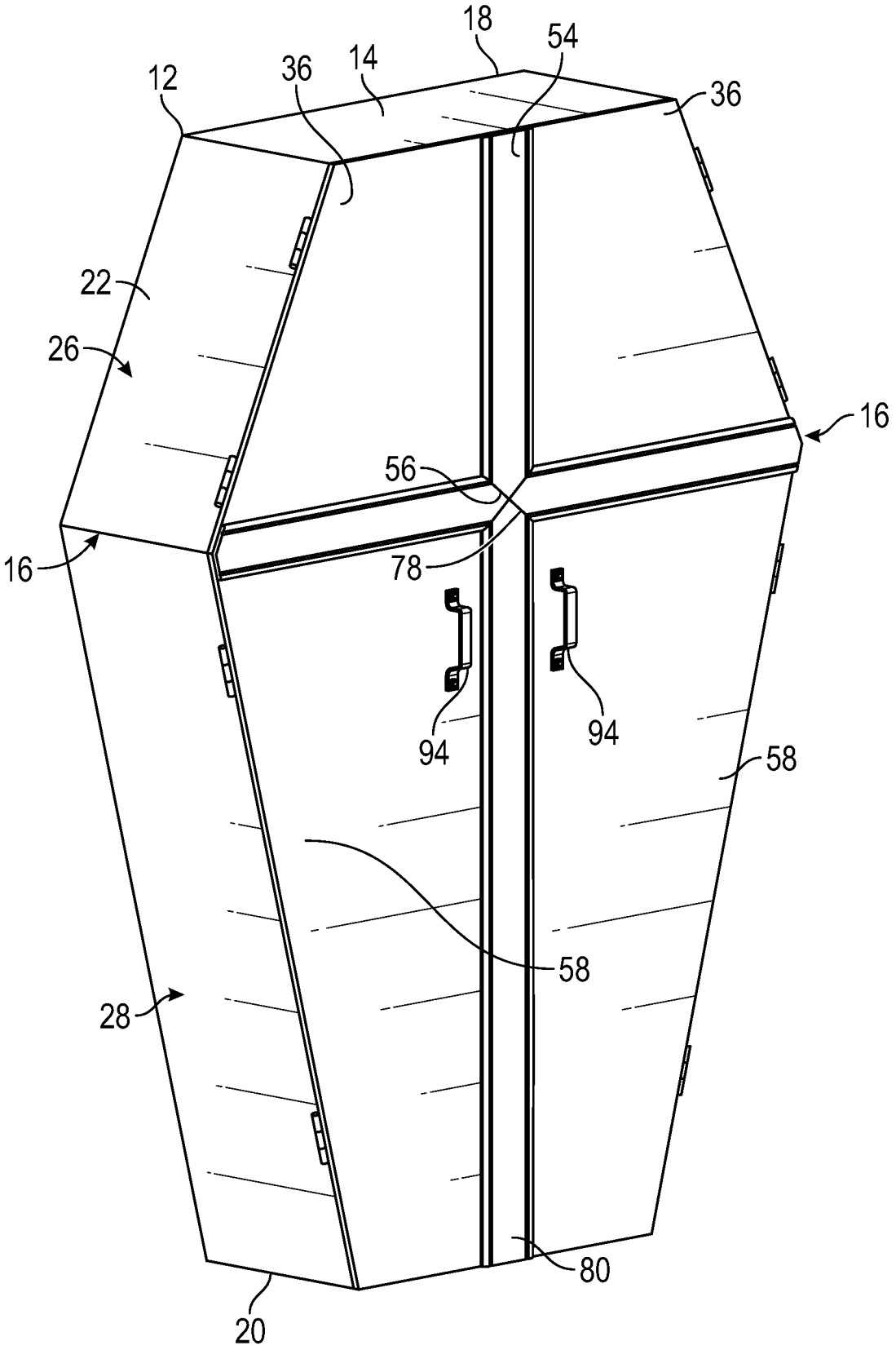
FIG. 1 is a front perspective view of a coffin shaped cabinet assembly according to an embodiment of the disclosure.
Figure 2:
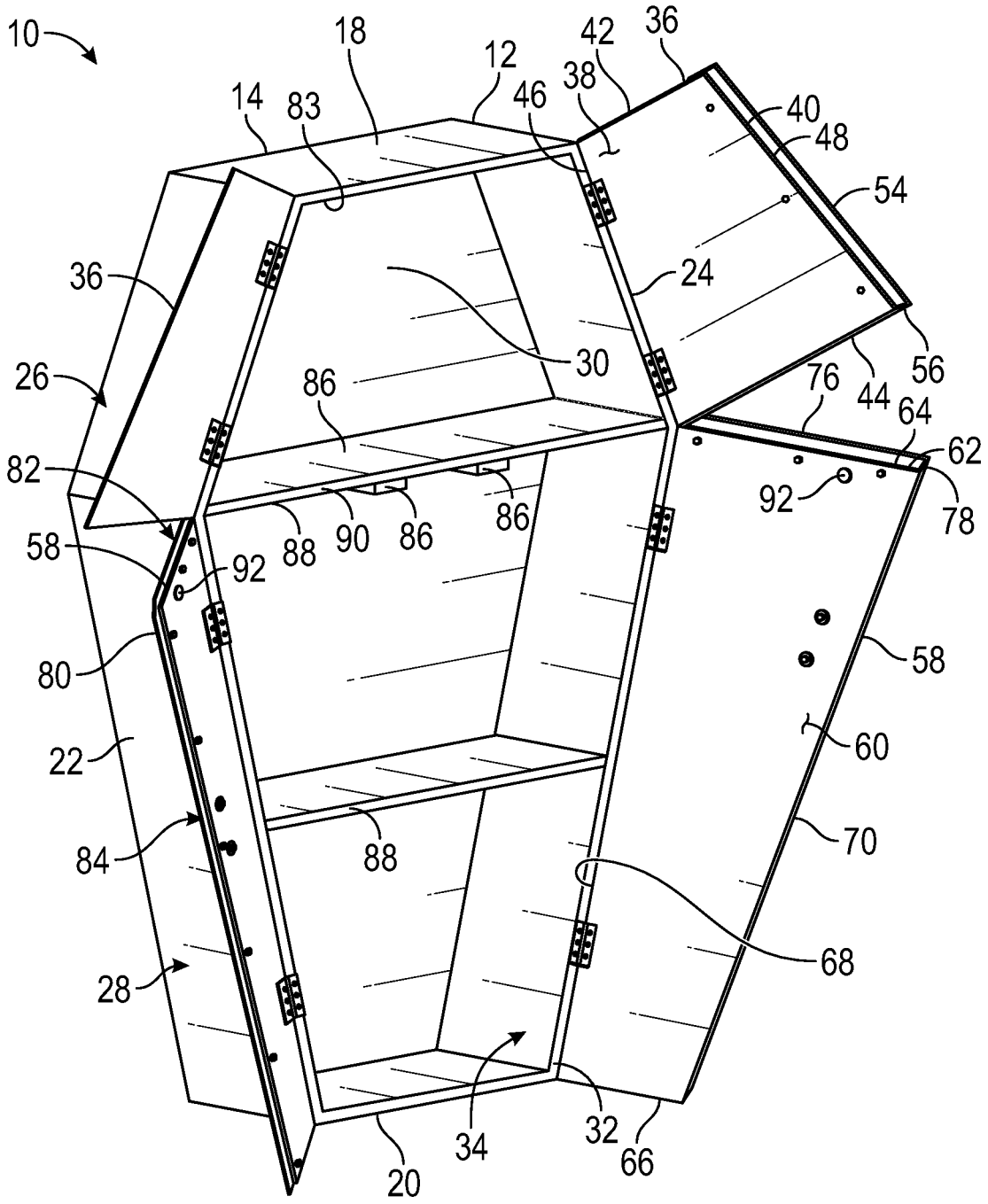
FIG. 2 is a perspective view of an embodiment of the disclosure.
Figure 3:
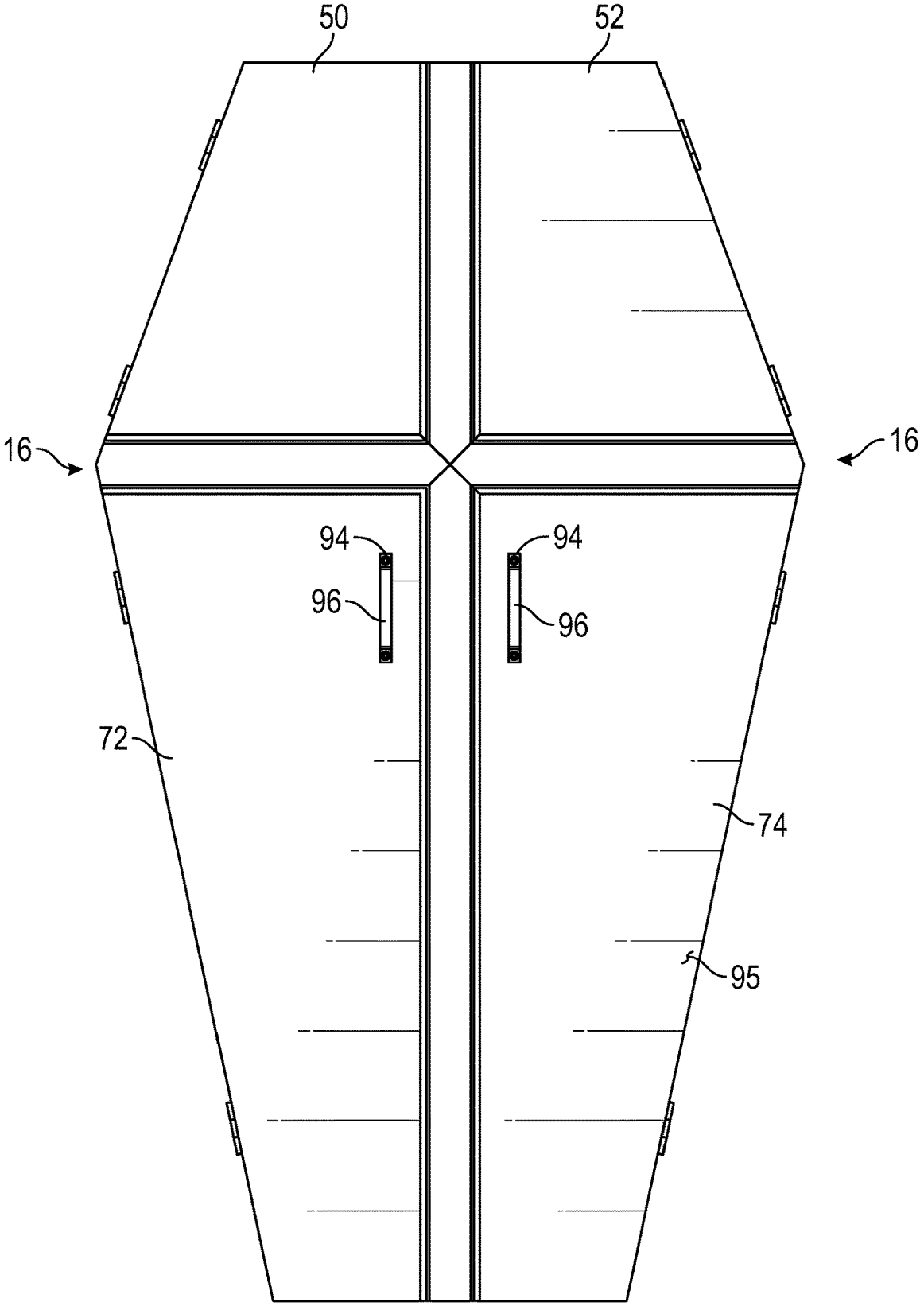
FIG. 3 is a front view of an embodiment of the disclosure.
Figure 4:
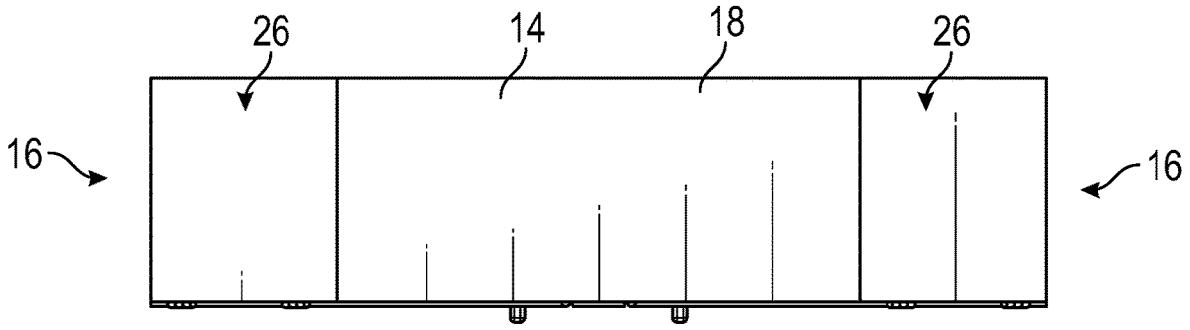
FIG. 4 is a top view of an embodiment of the disclosure.

With reference now to the drawings, and in particular to FIGS. 1 through 4 thereof, a new cabinet device embodying the principles and concepts of an embodiment of the disclosure and generally designated by the reference numeral 10 will be described.

As best illustrated in FIGS. 1 through 4, the coffin shaped cabinet assembly 10 generally comprises a cabinet 12 that has an outer wall 14 which has a pair of protrusions 16 on opposing sides of the cabinet 12 such that the cabinet 12 has the ornamental appearance of a coffin. The outer wall 14 has a top side 18, a bottom side 20, a first lateral side 22 and a second lateral side 24. Each of the first lateral side 22 and the second lateral side 24 has a first angled portion 26 which angles outwardly from the top side 18. Additionally, each of the first lateral side 22 and the second lateral side 24 has a second angled portion 28 which angles inwardly between the first angled portion 26 and the bottom side 20. Each of the first angled portion 26 and the second angled portion 28 of each of the first lateral side 22 and the second lateral side 24 intersects at a point located closer to the top side 18 than the bottom side 20 such that the point on each of the first lateral side 22 and the second lateral side 24 defines the protrusions 16.

The cabinet 12 has back wall 30 and the outer wall 14 has a distal edge 32 with respect to the back wall 30 defining an opening 34 in the cabinet 12. The top side 18 of the outer wall 14 may have a width ranging between approximately 14.0 inches and 16.0 inches and the bottom side 20 of the outer wall 14 may have a width ranging between approximately 16.0 inches and 18.0 inches. The cabinet 12 may have a height ranging between approximately 40.0 inches and 45.0 inches. Furthermore, each of the protrusions 16 may be spaced from the top side 18 of the outer wall 14 a distance ranging between approximately 14.0 inches and 16.0 inches.

A pair of first doors 36 is provided and each of the first doors 36 is hingedly coupled to the cabinet 12. Each of the first doors 36 is positioned adjacent to a respective one of the protrusions 16 on the outer wall 14 of the cabinet 12. Each of the first doors 36 has a rear surface 38 and a perimeter edge 40, and the perimeter edge 40 each of the first doors 36 has an upper side 42, a lower side 44, a first lateral side 46 and a second lateral side 48. The upper side 42 has length is less than a length of the lower side 44 such that each of the first doors 36 has a trapezoidal shape. The rear surface 28 of each of the first doors 36 rests against the distal edge 32 of the outer wall 14 of the cabinet 12 when the first doors 36 are in a closed position.

The pair of first doors 36 includes a left first door 50 and a right first door 52. The first lateral side 46 of the left first door 50 is hingedly coupled to the distal edge 32 corresponding to the first angled portion 26 of the first lateral side 46 of the outer wall 14 of the cabinet 12. The second lateral side 48 the right first door 52 is hingedly coupled to the distal edge 32 corresponding to the first angled portion 26 of the second lateral side 48 of the outer wall 14 of the cabinet 12. Furthermore, the second lateral side 48 of the perimeter edge 40 of the left first door 50 is aligned with the first lateral side 46 of the perimeter edge 40 of the right first door 52 when the left first door 50 and the right first door 52 are in the closed position.

A first trim member 54 is coupled to the first lateral side 46 of the perimeter edge 40 of the right first door 52. The first trim member 54 is coextensive with the first lateral side 46 of the perimeter edge 40 of the right first door 52. Additionally, the first trim member 54 has a lower end 56 that tapers to a point and the lower end 56 is positioned adjacent to the lower side 44 of the perimeter edge 40 of the right first door 52.

A pair of second doors 58 is provided and each of the second doors 58 is hingedly coupled to the cabinet 12. Each of the second doors 58 is positioned adjacent to a respective one of the protrusions 16 on the outer wall 14 of the cabinet 12. Each of the second doors 58 has a rear surface 60 and a perimeter edge 62, and the perimeter edge 62 each of the second doors 58 has an uppermost side 64, a lowermost side 66, a first lateral side 68 and a second lateral side 70. The uppermost side 64 has length that is greater than a length of the lowermost side 66 such that each of the second doors 58 has a trapezoidal shape. Additionally, the rear surface 60 of each of the second doors 58 rests against the distal edge 32 of the outer wall 14 of the cabinet 12 when the second doors 58 are in a closed position.

The pair of second doors 58 includes a left second door 72 and a right second door 74. The first lateral side 68 of the left second door 72 is hingedly coupled to the distal edge 32 corresponding to the second angled portion 28 of the first lateral side 46 of the outer wall 14 of the cabinet 12. Additionally, the second lateral side 70 the right second door 74 is hingedly coupled to the distal edge 32 corresponding to the second angled portion 28 of the second lateral side 48 of the outer wall 14 of the cabinet 12. The second lateral side 70 of the perimeter edge 40 of the left second door 72 is aligned with the first lateral side 68 of the perimeter edge 40 of the right second door 74 when the left second door 72 and the right second door 74 are in the closed position.

A second trim member 76 is coupled to the uppermost side 64 of the perimeter edge 62 of the right second door 74 and the second trim member 76 is coextensive with the uppermost side 64. The second trim member 76 has a first lateral end 78 and the first lateral end 78 of the second trim member 76 tapers to a point. The first lateral end 78 of the second trim member 76 is aligned with the first lateral side 68 of the perimeter edge 62 of the right second door 74. A third trim member 80 is coupled to the perimeter edge 40 of the left second door 72. The third trim member 80 has a first section 82 extending along the uppermost side 64 of the perimeter edge 40 of the left second door 72 and the third trim member 80 has a second section 84 extending along the second lateral side 48 of the perimeter edge 40 of the left second door 72.

An intersection between the first section 82 and the second section 84 extends along a diagonal line with respect to the uppermost side 64 and the second lateral side 48 of the perimeter edge 40 of the left second door 72. Furthermore, each of the first trim member 54, the second trim member 76 and the third trim member 80 intersect each other at a central point of the cabinet 12 when each of the first doors 36 and each of the second doors 58 are in the closed position. The first trim member 54, the second trim member 76 and the third trim member 80 define a cruciform shape when the first doors 36 and the second doors 58 are closed to enhance the ornamental appearance of the cabinet 12.

A first shelf 85 is positioned in the cabinet 12 and the first shelf 85 extends between the first lateral side 46 and the second lateral side 48 of the outer wall 14 of the cabinet 12. Additionally, the first shelf 85 is aligned with the protrusions 16 on the outer wall 14. A second shelf 88 is positioned in the cabinet 12 and the second shelf 88 extends between the first lateral side 46 and the second lateral side 48 of the outer wall 14 of the cabinet 12. The second shelf 88 is positioned between the first shelf 85 and the bottom side 20 of the outer wall 14 of the cabinet 12.

A pair of magnets 86 is each coupled to a lower surface 88 of the first shelf 85. Each of the magnets 86 is aligned with a front edge 90 of the first shelf 85 and each of the magnets 86 is centrally positioned between the first lateral side 46 and the second lateral side 48 of the outer wall 14 of the cabinet 12. Furthermore, each of the magnets is positioned on opposite sides of a center of the front edge 90. A pair of engagements 92 is each coupled to the rear surface 60 of a respective one of the second doors 58. Each of the engagements 92 is comprised of a ferromagnetic material. Furthermore, each of the engagements 92 magnetically engages a respective one of the magnets 86 when the second doors 58 are in the closed position for retaining the second doors 58 in the closed position.

A pair of handles 94 is each coupled to a respective one of the second doors 58 such that each of the handles 94 can be gripped for opening the second doors 58. Each of the handles 94 is positioned a front surface 95 of the respective second door 58. Each of the handles 94 has an elongate portion 96 that is spaced from the front surface 96 of the respective second door 58. Thus, the elongate portion 96 of each of the handles 94 can be gripped.

In use, the cabinet 12 is stood in an upright orientation on a horizontal support surface, such as a floor or the like. In this way a collection of objects can be positioned on the first shelf 85 and the second shelf 88 for displaying the objects. Furthermore, the ornamental appearance of the cabinet 12 in the shape of a coffin adds a visually appealing element to the overall appearance of the cabinet 12 and the objects displayed in the cabinet 12. The first doors 36 and the second doors 58 can be opened independently of each other to access or display the objects within the cabinet 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A coffin shaped cabinet assembly having the ornamental appearance of a coffin, said assembly comprising:

a cabinet having an outer wall which has a pair of protrusions on opposing sides of said cabinet such that said cabinet has the ornamental appearance of a coffin;

a pair of first doors, each of said first doors being hingedly coupled to said cabinet, each of said first doors being positioned adjacent to a respective one of said protrusions on said outer wall of said cabinet;

a pair of second doors, each of said second doors being hingedly coupled to said cabinet, each of said second doors being positioned adjacent to a respective one of said protrusions on said outer wall of said cabinet;

a first shelf being positioned in said cabinet;

a second shelf being positioned in said cabinet;

a pair of handles, each of said handles being coupled to a respective one of said second doors wherein each of said handles is configured to be gripped for opening said second doors;

wherein said outer wall has a top side, a bottom side, a first lateral side and a second lateral side, each of said first lateral side and said second lateral side having a first angled portion angling outwardly from said top side, each of said first lateral side and said second lateral side having a second angled portion angling inwardly between said first angled portion and said bottom side, each of said first angled portion and said second angled portion of each of said first lateral wall and said second lateral wall intersecting at a point located closer to said top side than said bottom side such that said point on each of said first lateral side and said second lateral side defines said protrusions, said cabinet having back wall, said outer wall having a distal edge with respect to said back wall defining an opening in said cabinet; and wherein each of said first doors has a rear surface and a perimeter edge, said perimeter edge each of said first doors having an upper side, a lower side, a first lateral side and a second lateral side, said upper side having a length being less than a length of said lower side such that each of said first doors has a trapezoidal shape, said rear surface of each of said first doors resting against said distal edge of said outer wall of said cabinet when said first doors are in a closed position.

2. The assembly according to claim 1, wherein said pair of first doors includes a left first door and a right first door, said first lateral side of said left first door being hingedly coupled to said distal edge corresponding to said first angled portion of said first lateral side of said outer wall of said cabinet, said second lateral side said right first door being hingedly coupled to said distal edge corresponding to said first angled portion of said second lateral side of said outer wall of said cabinet, said second lateral side of said perimeter edge of said left first door being aligned with said first lateral side of said perimeter edge of said right first door when said left first door and said right first door are in said closed position.

3. The assembly according to claim 2, further comprising a first trim member being coupled to said first lateral side of said perimeter edge of said right first door, said first trim member being coextensive with said first lateral side of said perimeter edge of said right first door, said first trim member having a lower end tapering to a point, said lower end being positioned adjacent to said lower side of said perimeter edge of said right first door.

4. The assembly according to claim 1, wherein:

said first shelf extends between said first lateral side and said second lateral side of said outer wall of said cabinet, said first shelf being aligned with said protrusions on said outer wall;

said second shelf extends between said first lateral side and said second lateral side of said outer wall of said cabinet, said second shelf being positioned between said first shelf and said bottom side of said outer wall of said cabinet.

5. A coffin shaped cabinet assembly having the ornamental appearance of a coffin, said assembly comprising:

a cabinet having an outer wall which has a pair of protrusions on opposing sides of said cabinet such that said cabinet has the ornamental appearance of a coffin;

a pair of first doors, each of said first doors being hingedly coupled to said cabinet, each of said first doors being positioned adjacent to a respective one of said protrusions on said outer wall of said cabinet;

a pair of second doors, each of said second doors being hingedly coupled to said cabinet, each of said second doors being positioned adjacent to a respective one of said protrusions on said outer wall of said cabinet;

a first shelf being positioned in said cabinet;

a second shelf being positioned in said cabinet;

a pair of handles, each of said handles being coupled to a respective one of said second doors wherein each of said handles is configured to be gripped for opening said second doors;

wherein said outer wall has a top side, a bottom side, a first lateral side and a second lateral side, each of said first lateral side and said second lateral side having a first angled portion angling outwardly from said top side, each of said first lateral side and said second lateral side having a second angled portion angling inwardly between said first angled portion and said bottom side, each of said first angled portion and said second angled portion of each of said first lateral wall and said second lateral wall intersecting at a point located closer to said top side than said bottom side such that said point on each of said first lateral side and said second lateral side defines said protrusions, said cabinet having back wall, said outer wall having a distal edge with respect to said back wall defining an opening in said cabinet; and wherein each of said second doors has a rear surface and a perimeter edge, said perimeter edge each of said second doors having an uppermost side, a lowermost side, a first lateral side and a second lateral side, said uppermost side having a length being greater than a length of said lowermost side such that each of said second doors has a trapezoidal shape, said rear surface of each of said second doors resting against said distal edge of said outer wall of said cabinet when said second doors are in a closed position.

6. The assembly according to claim 5, wherein said pair of second doors includes a left second door and a right second door, said first lateral side of said left second door being hingedly coupled to said distal edge corresponding to said second angled portion of said first lateral side of said outer wall of said cabinet, said second lateral side of said right second door being hingedly coupled to said distal edge corresponding to said second angled portion of said second lateral side of said outer wall of said cabinet, said second lateral side of said perimeter edge of said left second door being aligned with said first lateral side of said perimeter edge of said right second door when said left second door and said right second door are in said closed position.

7. The assembly according to claim 6, further comprising:

a first trim member being coupled to a respective one of said first doors; and a second trim member being coupled to said uppermost side of said perimeter edge of said right second door, said second trim member being coextensive with said uppermost side, said second trim member having a first lateral end, said first lateral end of said second trim member tapering to a point, said first lateral end of said second trim member being aligned with said first lateral side of said perimeter edge of said right second door.

8. The assembly according to claim 7, further comprising a third trim member being coupled to said perimeter edge of said left second door, said third trim member having a first section extending along said uppermost side of said perimeter edge of said left second door, said third trim member having a second section extending along said second lateral side of said perimeter edge of said left second door, an intersection between said first section and said second section extending along a diagonal line with respect to said uppermost side and said second lateral side of said perimeter edge of said left second door.

9. The assembly according to claim 8, wherein each of said first trim member, said second trim member and said third trim member intersects each other at a central point of said cabinet when each of said first doors and each of said second doors are in said closed position.

10. The assembly according to claim 5, further comprising:

a pair of magnets, each of said magnets being coupled to a lower surface of said first shelf, each of said magnets being aligned with a front edge of said first shelf, each of said magnets being positioned on opposite sides of a center of said front edge; and a pair of engagements, each of said engagements being coupled to said rear surface of a respective one of said second doors, each of said engagements being comprised of a ferromagnetic material, each of said engagements magnetically engaging a respective one of said magnets when said second doors are in said closed position for retaining said second doors in said closed position.

11. The assembly according to claim 5, wherein each of said handles is positioned a front surface of said respective second door, each of said handles having an elongate portion being spaced from said front surface of said respective second door wherein said elongate portion of each of said handles is configured to be gripped.

12. A coffin shaped cabinet assembly having the ornamental appearance of a coffin, said assembly comprising:

a cabinet having an outer wall which has a pair of protrusions on opposing sides of said cabinet such that said cabinet has the ornamental appearance of a coffin, said outer wall having a top side, a bottom side, a first lateral side and a second lateral side, each of said first lateral side and said second lateral side having a first angled portion angling outwardly from said top side, each of said first lateral side and said second lateral side having a second angled portion angling inwardly between said first angled portion and said bottom side, each of said first angled portion and said second angled portion of each of said first lateral wall and said second lateral wall intersecting at a point located closer to said top side than said bottom side such that said point on each of said first lateral side and said second lateral side defines said protrusions, said cabinet having back wall, said outer wall having a distal edge with respect to said back wall defining an opening in said cabinet;

a pair of first doors, each of said first doors being hingedly coupled to said cabinet, each of said first doors being positioned adjacent to a respective one of said protrusions on said outer wall of said cabinet, each of said first doors having a rear surface and a perimeter edge, said perimeter edge each of said first doors having an upper side, a lower side, a first lateral side and a second lateral side, said upper side having length being less than a length of said lower side such that each of said first doors has a trapezoidal shape, said rear surface of each of said first doors resting against said distal edge of said outer wall of said cabinet when said first doors are in a closed position, said pair of first doors including a left first door and a right first door, said first lateral side of said left first door being hingedly coupled to said distal edge corresponding to said first angled portion of said first lateral side of said outer wall of said cabinet, said second lateral side of said right first door being hingedly coupled to said distal edge corresponding to said first angled portion of said second lateral side of said outer wall of said cabinet, said second lateral side of said perimeter edge of said left first door being aligned with said first lateral side of said perimeter edge of said right first door when said left first door and said right first door are in said closed position;

a first trim member being coupled to said first lateral side of said perimeter edge of said right first door, said first trim member being coextensive with said first lateral side of said perimeter edge of said right first door, said first trim member having a lower end tapering to a point, said lower end being positioned adjacent to said lower side of said perimeter edge of said right first door;

a pair of second doors, each of said second doors being hingedly coupled to said cabinet, each of said second doors being positioned adjacent to a respective one of said protrusions on said outer wall of said cabinet, each of said second doors having a rear surface and a perimeter edge, said perimeter edge each of said second doors having an uppermost side, a lowermost side, a first lateral side and a second lateral side, said uppermost side having length being greater than a length of said lowermost side such that each of said second doors has a trapezoidal shape, said rear surface of each of said second doors resting against said distal edge of said outer wall of said cabinet when said second doors are in a closed position, said pair of second doors including a left second door and a right second door, said first lateral side of said left second door being hingedly coupled to said distal edge corresponding to said second angled portion of said first lateral side of said outer wall of said cabinet, said second lateral side said right second door being hingedly coupled to said distal edge corresponding to said second angled portion of said second lateral side of said outer wall of said cabinet, said second lateral side of said perimeter edge of said left second door being aligned with said first lateral side of said perimeter edge of said right second door when said left second door and said right second door are in said closed position;

a second trim member being coupled to said uppermost side of said perimeter edge of said right second door, said second trim member being coextensive with said uppermost side, said second trim member having a first lateral end, said first lateral end of said second trim member tapering to a point, said first lateral end of said second trim member being aligned with said first lateral side of said perimeter edge of said right second door;

a third trim member being coupled to said perimeter edge of said left second door, said third trim member having a first section extending along said uppermost side of said perimeter edge of said left second door, said third trim member having a second section extending along said second lateral side of said perimeter edge of said left second door, an intersection between said first section and said second section extending along a diagonal line with respect to said uppermost side and said second lateral side of said perimeter edge of said left second door, each of said first trim member, said second trim member and said third trim member intersecting each other at a central point of said cabinet when each of said first doors and each of said second doors are in said closed position;

a first shelf being positioned in said cabinet, said first shelf extending between said first lateral side and said second lateral side of said outer wall of said cabinet, said first shelf being aligned with said protrusions on said outer wall;

a second shelf being positioned in said cabinet, said second shelf extending between said first lateral side and said second lateral side of said outer wall of said cabinet, said second shelf being positioned between said first shelf and said bottom side of said outer wall of said cabinet;

a pair of magnets, each of said magnets being coupled to a lower surface of said first shelf, each of said magnets being aligned with a front edge of said first shelf, each of said magnets being positioned on opposite sides of a center of said front edge;

a pair of engagements, each of said engagements being coupled to said rear surface of a respective one of said second doors, each of said engagements being comprised of a ferromagnetic material, each of said engagements magnetically engaging a respective one of said magnets when said second doors are in said closed position for retaining said second doors in said closed position; and a pair of handles, each of said handles being coupled to a respective one of said second doors wherein each of said handles is configured to be gripped for opening said second doors, each of said handles being positioned a front surface of said respective second door, each of said handles having an elongate portion being spaced from said front surface of said respective second door wherein said elongate portion of each of said handles is configured to be gripped.

* * * * *